US005480477A

United States Patent [19]

Feldstein et al.

[11] Patent Number: 5,480,477

[45] Date of Patent: Jan. 2, 1996

[54] COBALT AS A STABILIZER IN ELECTROLESS PLATING FORMULATIONS

[75] Inventors: Nathan Feldstein, Princeton, N.J.; Thomas S. Lancsek, Yardley, Pa.

[73] Assignee: Surface Technology, Inc., Trenton, N.J.

[21] Appl. No.: 459,429

[22] Filed: Jun. 2, 1995

[51] Int. Cl.[6] ..... C23C 18/31

[52] U.S. Cl. ..... 106/1.24; 106/1.22; 106/1.23; 106/1.27; 427/443.1

[58] Field of Search ..... 106/1.22, 1.23, 106/1.24, 1.27; 427/443.1

[56] References Cited

U.S. PATENT DOCUMENTS 3,915,717 10/1975 Feldstein et al. ..... 106/1.24
3,962,494 6/1976 Nuzzi et al. ..... 106/1.26
4,255,194 3/1981 Hough et al. ..... 106/1.24
4,884,739 7/1989 Josso et al. ..... 106/1.22
4,987,559 12/1990 Iacovangelo ..... 106/1.22
5,300,330 4/1994 Feldstein et al. ..... 106/1.24

*Primary Examiner*—Helene Klemanski

[57] ABSTRACT

A process for the electroless deposition of metals and alloys onto a substrate by immersion of the substrate into an electroless plating composition. Said electroless plating composition comprises a solvent, a metallic compound, an electroless reducing agent, a complexing agent and/or chelating agent, and a compound comprising cobaltic ions. The presence of the cobaltic ions assists in the stabilization of this composition of matter.

2 Claims, No Drawings

COBALT AS A STABILIZER IN ELECTROLESS PLATING FORMULATIONS

SUMMARY OF THE INVENTION

This invention provides a new composition of matter for electroless metal deposition. The new electroless plating composition incorporates ions of cobalt in its cobaltic (+3) oxidation state. The use of this new stabilizer is particularly useful in the elimination of certain heavy metal ions such as lead and cadmium which are highly undesirable.

BACKGROUND OF THE INVENTION

Electroless plating is a well documented process which has evolved into a mature science with many commercial applications. During the last forty years hundreds of patents were issued and texts published describing the various improvements to this basic autocatalytic phenomenon in which metals and alloys can be deposited without the use of an external power supply. Electroless plating can be used for the deposition of many metals, including but not limited to: nickel, cobalt, copper, precious metals and various alloys such as tin-lead, and others. Perhaps one of the more recent texts entitled "Electroless Plating Fundamentals and Applications" edited by G. Mallory and J. Hadju, published by The American Electroplaters and Surface Finishers Society, Inc., Orlando, Fla., 1990, describes the state of the art in conventional electroless plating of the various metals and alloys-including typical formulations and performance. In the typical electroless plating formulation there are certain key components which are common from bath to bath. These key components can be described as: 1) a metal salt as a source for the metal ions; 2) an electroless reducing agent which provides through interaction with the surface the reducing capability of the surface; 3) a complexing agent and/or chelating agent to complex and tie the metal ions and thereby insure their stability and; 4) stabilizers which are added to insure that no homogeneous decomposition takes place and that the chemical reduction of the metal ion be limited to the surface of the substrate only. In many of the electroless formulations, a wide variety of reducing agents have been reported ranging from sodium hypophosphite, formaldehyde, hydrazine, and amine-borane, and its derivatives. Much of the successful commercial developments of electroless technology has relied upon the utilization of stabilizers. Though there are many stabilizers reported in the literature, some of the more effective stabilizers belong to the following classes.

I. Compounds of group VI elements, i.e., sulfur, selenium, tellurium and others.

II. Compounds containing oxygen, i.e., arsenite, bromate, iodate, molybade and tungstate and others.

III. Heavy metal ions, i.e., Lead, mercury, thalium, tin, cadmium and others.

IV. Unsaturated organic compounds: maleic, itaconic and others.

The presence of the stabilizer(s) and its concentration(s) is particularly critical for it has been noted that excess addition may create a complete cessation of the plating process. In fact, monitoring the plating rate or the mixed potential developed vs. the stabilizer concentration generally provides a curve similar to titrations in analytical chemistry. Exceeding a critical concentration will create cessation of the plating. This phenomenon has been reported by N. Feldstein and P. Amadio, Jr. ElectroChem. Society, 117, 1110, (1970) and is also described in the above text at page 36 and 37. As was noted above, some of the stabilizers used though highly effective, are highly undesirable. For instance, the use of thallium is undesirable. The use of mercury is also highly undesirable. The use of lead is undesirable in certain applications, e.g., food industry. Consequently, there is a continuous need for a new type of stabilizer which will not be poisonous and potentially hazardous when trapped in the coating or adversely affect the environment.

It has now been discovered that the use of a cobaltic type product provides the characteristics associated with typical stabilizers. Consequently, the adaptation of this new class of stabilizer will open up new avenues for processes and compositions for electroless plating of the various metals and alloys with a metallic ion which is not poisonous or detrimental when incorporated into the coating and used in food applications and others.

DETAILED DESCRIPTION OF THE PREFERRED EMBODIMENT

From the background of the invention it is recognized that there are virtually hundreds of compositions reported for electroless (chemical) metal deposition in which a wide variety of metals and alloys can be deposited along with miscellaneous reducing agents, along with miscellaneous complexing agents, along with miscellaneous buffering agents, along with miscellaneous exaltants, and along with miscellaneous stabilizers.

The following examples are provided to demonstrate the concept to the present invention.

EXAMPLE 1

In this example, 1-liter of an electroless plating bath comprising of nickel sulfate hexahydrate 28 grams per liter; sodium acetate 17 grams per liter; sodium hypophosphite monohydrate 24 grams per liter; with a pH adjusted to 5.0 and a temperature of 80° [C.] was used. Into this composition a stock solution of cobaltic hexamine chloride $[Co(NH_3)_6]Cl_3$ having a molecular weight of 267.48 and a concentration of 100 grams per liter was incorporated. This stock solution of the cobaltic compound was titrated in slow increments and the resulting mixed potential vs. a reference calomel electrode was monitored. As noted in the results, upon the addition of approximately 10.0 ml of said stock solution to 1-liter of the plating bath, a rapid and sharp drop in the mixed potential resulted, e.g., from approximately −658 mv to approximately −381 mv took place. This drop represents the classical behavior associated with stabilizers.

Results of Added Cobaltic Stock Solution

| ML | MV |
|---|---|
| 0 | 622 |
| 0.1 | 622 |
| 0.5 | 661 |
| 0.8 | 661 |
| 1.0 | 662 |
| 1.5 | 660 |
| 2.0 | 660 |
| 2.5 | 661 |
| 3.0 | 660 |
| 3.5 | 660 |
| 4.0 | 659 |
| 4.5 | 660 |
| 5.0 | 660 |
| 6.0 | 659 |
| 7.0 | 658 |

-continued

| Results of Added Cobaltic Stock Solution | |
|---|---|
| ML | MV |
| 8.0 | 657 |
| 9.0 | 657 |
| 9.5 | 657 |
| 10.0 | 658 |
| 10.1 | 381 |
| 10.2 | 362 |
| 10.3 | 360 |
| 10.4 | 364 |
| 11.5 | 360 |

All MV data are negative vs. the calomel reference electrode.

EXAMPLE 2

Example 1 above was repeated with using the same approach. The results are as follows:

| ML | MV |
|---|---|
| 0 | 661 |
| 0.1 | — |
| 0.5 | — |
| 0.8 | — |
| 1.0 | 661 |
| 1.5 | — |
| 2.0 | 661 |
| 2.5 | — |
| 3.0 | 660 |
| 3.5 | — |
| 4.0 | 660 |
| 4.5 | — |
| 5.0 | 659 |
| 6.0 | 660 |
| 7.0 | 659 |
| 8.0 | 658 |
| 9.0 | 657 |
| 10.0 | 658 |

-continued

| ML | MV |
|---|---|
| 10.1 | 657 |
| 10.2 | 368 |
| 10.3 | 365 |
| 10.4 | 364 |
| 11.5 | 361 |

All MV data are negative vs. the calomel reference electrode

Therefore, based upon these results, it has been demonstrated that cobaltic ions provide the classical characteristics associated with stabilizers. Though the above two examples have been demonstrated with respect to electroless nickel, it will be a simple and straightforward procedure using the same cobaltic composition or other cobaltic compounds and titration in a similar manner with other electroless plating compositions of any metals, alloys and/or other reducing agents. The procedure used in the above examples was a matter of a few minutes.

Therefore, it should be apparent to one skilled in the art that this invention in its broad sense utilizes cobaltic ions (cobalt in its +oxidation state) as a stabilizer in electroless plating formulations, and the process of metal deposition alloy via electroless plating.

What is claimed is:

1. A process for the electroless plating of a metal comprising the step of contacting a substrate with a composition comprising; a solvent, a metal salt, and electroless plating reducing agent, a complexing agent and/or a chelating agent, and a compound comprising a cobalt in the cobaltic oxidation state.

2. A composition of matter useful for electroless plating which comprises; a solvent, a metal salt, and electroless plating reducing agent, a complexing agent and/or chelating agent, and a compound comprising of cobalt in the cobaltic oxidation state.

* * * * *